US010300719B2

(12) United States Patent
Pawlowski

(10) Patent No.: US 10,300,719 B2
(45) Date of Patent: May 28, 2019

(54) ROTATING A PRINTHEAD RELATIVE TO VERTICAL

(71) Applicant: HEWLETT-PACKARD DEVELOPMENT COMPANY, L.P., Houston, TX (US)

(72) Inventor: Norman E. Pawlowski, Corvallis, OR (US)

(73) Assignee: HEWLETT-PACKARD DEVELOPMENT COMPANY, L.P., Spring, TX (US)

( * ) Notice: Subject to any disclaimer, the term of this patent is extended or adjusted under 35 U.S.C. 154(b) by 0 days.

(21) Appl. No.: 15/747,732

(22) PCT Filed: Oct. 2, 2015

(86) PCT No.: PCT/US2015/053651
§ 371 (c)(1),
(2) Date: Jan. 25, 2018

(87) PCT Pub. No.: WO2017/058241
PCT Pub. Date: Apr. 6, 2017

(65) Prior Publication Data

US 2018/0215180 A1 Aug. 2, 2018

(51) Int. Cl.
*B41J 2/155* (2006.01)
*B41J 2/165* (2006.01)
(Continued)

(52) U.S. Cl.
CPC ..... *B41J 25/316* (2013.01); *B41J 2/155* (2013.01); *B41J 2/165* (2013.01); *B41J 2/16508* (2013.01);
(Continued)

(58) Field of Classification Search
CPC ..... B41J 2/155; B41J 2/165; B41J 2/16508; B41J 2/16511; B41J 2/16585; B41J 2/17; B41J 2/2107; B41J 25/316; B41J 29/38
See application file for complete search history.

(56) References Cited

U.S. PATENT DOCUMENTS 5,120,135 A 6/1992 Ullman
5,548,309 A * 8/1996 Okubo ..... B41J 2/16508 347/33
(Continued)

FOREIGN PATENT DOCUMENTS

JP 05338195 A 12/1993
WO 2012138366 A1 10/2012

OTHER PUBLICATIONS

Pawlowski Jr., WO2017058241, Written Opinion, dated Oct. 2015, 10 pages.
(Continued)

*Primary Examiner* — Anh T Vo
(74) *Attorney, Agent, or Firm* — HP Inc. Patent Department

(57) ABSTRACT

In one example, a printer having a rotation mechanism coupleable to a liquid-ejecting printhead in the printer. The printer includes a controller coupled to the rotation mechanism to control the rotation mechanism to intermittently rotate the printhead, during a non-printing time, from a first orientation relative to vertical to a second orientation relative to vertical and back to the first orientation.

20 Claims, 8 Drawing Sheets

(51) Int. Cl.

| | |
|---|---|
| ***B41J 25/316*** | (2006.01) |
| ***B41J 29/38*** | (2006.01) |
| ***B41J 2/17*** | (2006.01) |
| ***B41J 2/21*** | (2006.01) |

(52) U.S. Cl.
CPC ..... *B41J 2/16511* (2013.01); *B41J 2/17* (2013.01); *B41J 2/2107* (2013.01); *B41J 29/38* (2013.01)

(56) References Cited

U.S. PATENT DOCUMENTS

| | | | | |
|---|---|---|---|---|
| 5,757,398 | A * | 5/1998 | Anderson | B41J 2/1652 347/30 |
| 6,913,341 | B2 * | 7/2005 | Barinaga | B41J 2/16517 347/29 |
| 7,357,476 | B2 * | 4/2008 | Berry | B41J 2/16505 347/29 |
| 8,262,198 | B2 * | 9/2012 | Ishii | B21D 53/76 347/20 |
| 8,322,807 | B2 | 12/2012 | Seki et al. | |
| 9,162,503 | B2 * | 10/2015 | Monteiro | B41J 2/14 |
| 2003/0081055 | A1 * | 5/2003 | Wotton | B41J 2/155 347/33 |
| 2004/0027415 | A1 | 2/2004 | Yamashita et al. | |
| 2004/0027914 | A1 | 2/2004 | Vrane et al. | |
| 2006/0079146 | A1 | 4/2006 | Bae et al. | |
| 2010/0253739 | A1 | 10/2010 | Berry et al. | |
| 2012/0262523 | A1 | 10/2012 | Levi et al. | |
| 2013/0021415 | A1 | 1/2013 | Walker et al. | |
| 2013/0271517 | A1 | 10/2013 | Leoni et al. | |

OTHER PUBLICATIONS

Pawlowski Jr., WO2017058241, International Search Report, dated Oct. 2015, 2 pages.

Asgharian, B., et al., "Particle Suspension in a Rotating Drum Chamber When the Influence of Gravity and Rotation are Both Significant," Aerosol Science and Technology, 17:4, pp. 263-277, Jun. 11, 2007.

* cited by examiner

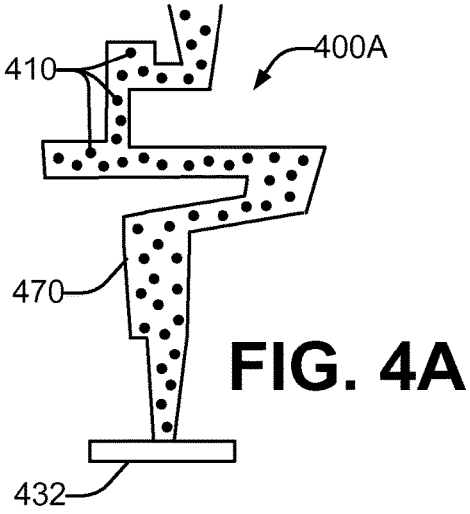
FIG. 4A
FIG. 4B
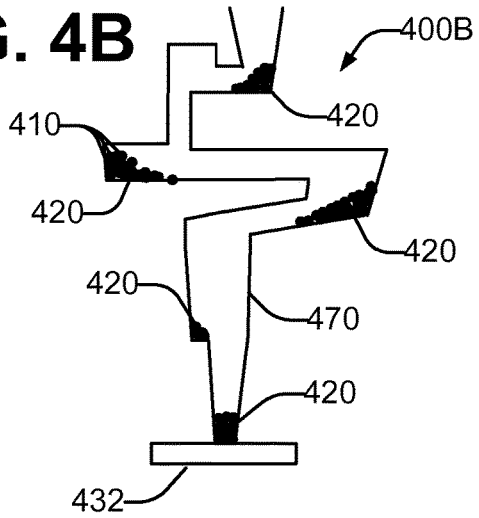
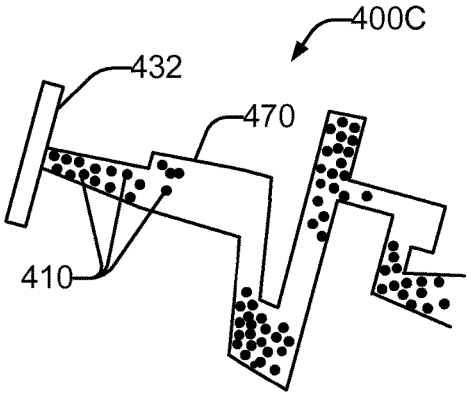
FIG. 4C
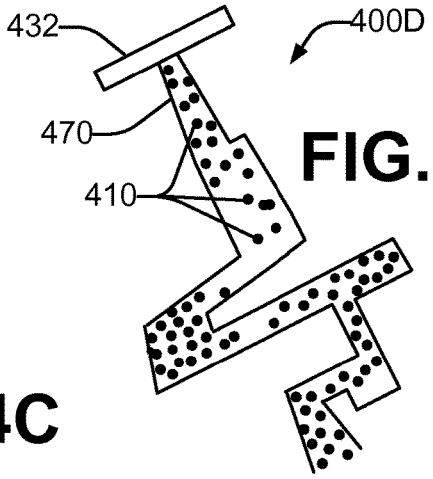
FIG. 4D
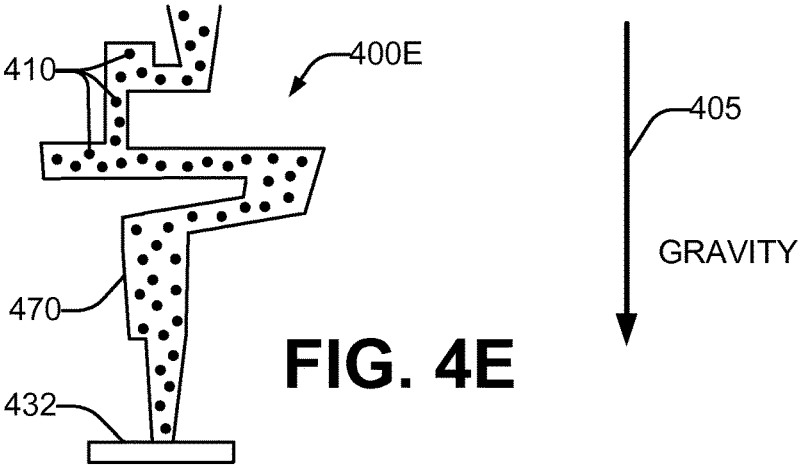
FIG. 4E

600

ROTATING A PRINTHEAD RELATIVE TO VERTICAL

BACKGROUND

As inkjet printing advances, new inks and other liquids are being developed to address new or different printing needs. Some of these new inks and liquids have different characteristics than prior ones used with inkjet printing, and can present challenges for consistently and reliably producing print output having a desired level of image quality.

BRIEF DESCRIPTION OF THE DRAWINGS

FIGS. 4A-4E are schematic illustrations of gravitational effects upon particles in a liquid within an example printhead or printbar at various stages of rotation in accordance with an example of the present disclosure.

DETAILED DESCRIPTION

Figure 1A:
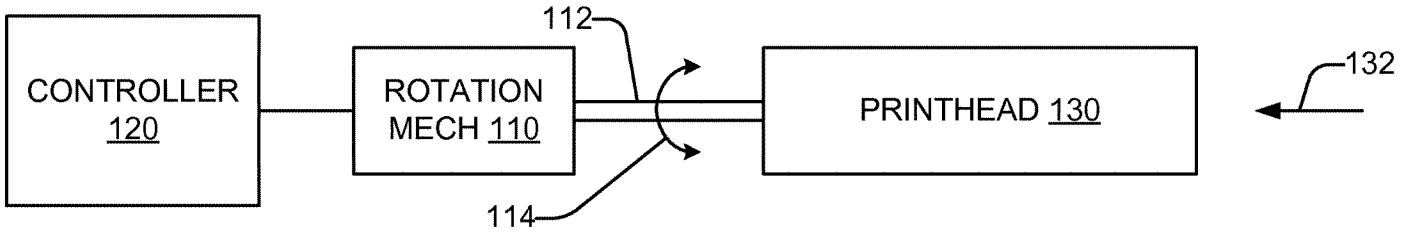
FIG. 1A is a schematic block diagram of a printing system in accordance with an example of the present disclosure.

Inkjet printing devices are widely used. For instance, some of the printing devices in which the present disclosure, described below, may be embodied include inkjet printers for home, office, commercial, or industrial printing applications. The printer may be a stand-alone device, or combined into another device such as a fax machine, copier, or an all-in-one device (e.g. a combination of at least two of a printer, scanner, copier, and fax), to name a few. The printer may print on a print medium that may be any type of suitable sheet or roll material, such as paper, card stock, cloth or other fabric, transparencies, mylar, and the like.

Some new liquids used for inkjet printing, such as white ink for example, contain large pigment particles and other components in suspension that can settle with time when the ink is stagnant—i.e. not flowing through the printing system. This can occur when the printer is powered off. It can also occur when the printer is powered on but no printing is occurring—i.e. when the printer is idle. Some liquids are non-Newtonian in nature and become thicker as they sit. Some liquids have heavier components that create highly viscous sediment when they settle. Some liquids have particles of larger diameters and/or which exist in the liquid in higher densities, which can result in increased settling. One such example is titanium dioxide-based white inks, in which the pigment particles can exceed 200 nanometers in diameter.

Settling of liquid components can degrade image quality of print output if the concentration of these components varies from the top to the bottom of a printhead and/or printbar. A printhead can become nonoperational if portions of the liquid delivery system become plugged when certain portions of the liquid delivery system become plugged with sediment. Thus it is desirable to keep the liquids properly mixed both during use, and after long idle periods where no printing occurs.

However, in many inkjet printing systems it is challenging to keep fluids properly mixed, because the geometry of the liquid flow paths can vary in size from the top to the bottom of the printhead and/or printbar. In some examples, the liquid flow path has large open areas around a filter towards the top, and smaller channels near printhead die at the bottom. Also, some fluid piping and manifolding systems have zones of reduced liquid flow, such as for example large boundary layers or "dead zones" in places where the geometry changes in size or shape, is not of consistent circular diameter, or has parallel flow channels. The reduced liquid flow is less than a nominal liquid flow.

Some systems recirculate the liquid with pumps in order to maintain proper mixing. However, such systems are often complex, noise-producing, and relatively ineffective since ink cannot be adequately mixed everywhere in the liquid flow path, especially in areas that are not cylindrical in cross section, regardless of flow rates. Liquid components can settle even if recirculation is done continuously. Once particles become settled in low energy (stagnant) flow areas, such as in corners and pockets of the flow path, these particles often do not remix even if recirculation is used.

Furthermore, some printing systems, such as for example page-wide array printhead systems in which multiple printhead die are disposed in a printbar which spans the entire printable width of a print medium, present multiple flow paths which can become plugged. Such page wide printheads have ink flowing in through manifolds with multiple paths to the multiple printhead die. This is analogous to multiple channels in a river delta, where settling increases as lower flow rate paths fill with sediment, eventually leaving one of the flow paths open but others clogged. Recirculation is ineffective in keeping liquids mixed in such multiple flow path printbars. After a long idle period, particles settle at the bottom and plug the liquid flow to the nozzles of the printhead die. Recirculation is also ineffective at clearing these plugs of settled liquid components. Recirculation has to provide enough pressure to break loose settled pigment. However, once one of the parallel flow paths is cleared, the other parallel ones will not be since the increase flow will be channels to the cleared path instead.

Referring now to the drawings, there is illustrated an example of a printer in which a printhead is rotated in order to disperse particle sediment within a liquid in the printhead and/or maintain particles in liquid suspension or solution. Considering now a printer, and with reference to FIGS. 1A-1B, a printer 100 includes a printhead rotator or rotation mechanism 110. The rotation mechanism 110 can be coupled to a liquid-ejecting printhead 130 that is installed in the printer 100. In many examples, the printhead 130 is removably installed in the printer 100, as the printhead 130 may be changed and/or replaced from time to time. The printer 100 also includes a controller 120 that is communicatively coupled to the rotation mechanism 110. The controller 120 controls the rotation mechanism 110 so as to intermittently rotate the printhead 130. The printhead 130 is rotated during a non-printing time. The rotation mechanism 110 rotates the printhead 130: (a) from a first orientation relative to vertical; (b) to a second orientation relative to vertical; and (c) back to the first orientation.

A "printhead", as used herein and in the claims, may be understood to mean a device to controllably eject or emit drops of a liquid via inkjet technology onto a print medium that is adjacent the printhead. Inkjet technology may be thermal inkjet, piezoelectric inkjet, or other types. The printhead is controlled by a controller, such as for example controller 120, such that the liquid drops form a pattern of desired size, shape, and color on the print medium. The pattern may represent text, graphics, images, or other items. A bulk supply of the liquid may be provided internal to the printhead and/or external to the printhead. In some examples, the printhead includes at least one "printhead die", a MEMS (micro-electro-mechanical system) micromachine formed on a substrate at least in part through semiconductor fabrication techniques. Such a printhead die has electrical and fluidic functions. Within the printhead, the liquid flows through a liquid flow path from the ink supply to the printhead die, where the liquid drops are ejected or emitted from nozzles of an ink ejection element of the printhead die in response to electrical signals received from the controller. In some examples, the printhead may be maintained in a fixed position during a printing operation. In other examples, the printhead may be mounted on a carriage and moved (or "scanned") during a printing operation in a direction that may be orthogonal to a direction of movement of the print medium.

Figure 1B:
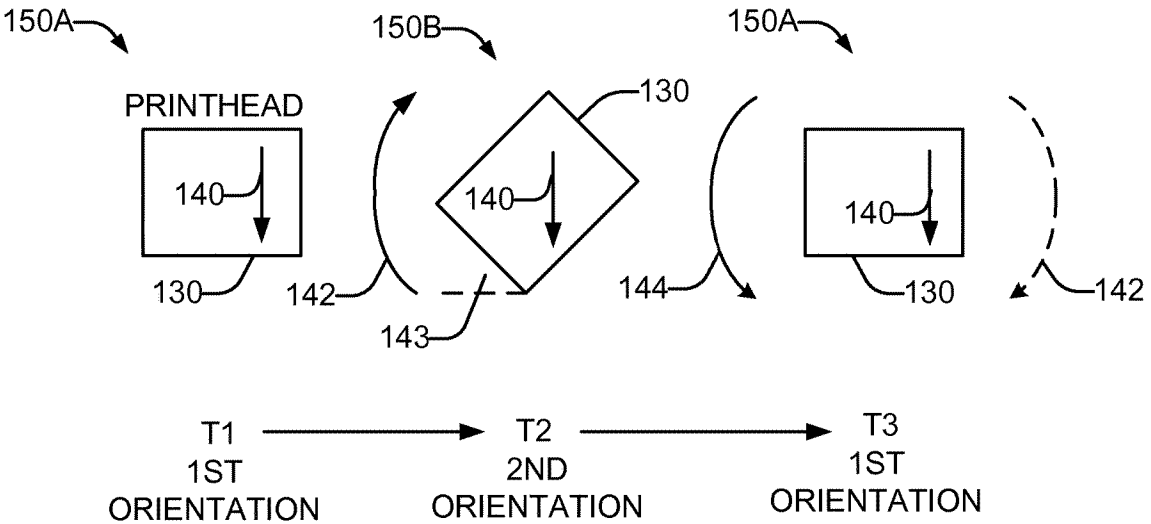
FIG. 1B is a schematic illustration of gravitational effects during rotation of a printhead of the printing system of FIG. 1A in accordance with an example of the present disclosure.

Considering the rotation of the printhead 130 in greater detail, and with reference to FIG. 1B which illustrates side views of the printhead 130 looking in the direction 132, the main cause of particle settling in liquids is gravity. Gravity pulls the particles to settle, rather than remaining in suspension or solution. By rotating the printhead 130, the directional vector 140 (in the downward vertical direction) which gravity asserts on the liquid particles within the printhead 130 is changed. By doing so, the particles within the printhead can be maintained in suspension or solution. Where settling of the particles has occurred, the settled particles within the printhead 130 can be returned to suspension or solution, and clogs in the printhead 130 caused by such settled particles can be cleared. With regard to the rotation, at time T1 the printhead 130 is in a first orientation 150A relative to vertical, as illustrated by the gravity vector 140. In some examples, the first orientation is a printing orientation in which the printhead 130 can be controlled to eject drops of the liquid onto a print medium (not shown) positioned adjacent the printhead 130. In other examples, the first orientation 150A is a non-printing orientation such as, for example, an idle or storage orientation.

The printhead 130 is then rotated by the rotation mechanism 110 a particular angular distance in the direction 142 to a second orientation 150B. In the second orientation at time T2, the gravity vector 140 has a different angular direction, with respect to the frame of reference of the printhead 130, due to the rotation of the printhead 130. The angular distance corresponds to an angle of rotation 143 of the printhead 130.

The rotation mechanism 110 then rotates the printhead 130 to return it to the first orientation. In some examples the rotation mechanism 110 rotates the printhead 130 from the second orientation 150B to the first orientation 150A in the same angular direction 142. Thus in these examples, the printhead 130 is rotated through an angular distance of 360 degrees in total. In other examples the rotation mechanism 110 rotates the printhead 130 from the second orientation 150B to the first orientation 150A in an angular direction 144 that is opposite the angular direction 142. Thus in these examples, the printhead 130 is rotated through the angle 143, which is less than 360 degrees. In some examples, the rotation angle 143 is 180 degrees or less such as, for example, 120 degrees. The rotation angle 143 may be selected based on the characteristics of the particular type of liquid. In some examples, a smaller angular distance of rotation allows for use of a simpler rotation mechanism 110.

Besides the rotation angle 143, other rotation parameters may be determined based on the fluid characteristics. One rotation parameter is rotation speed. In some examples, the rotation mechanism 110 rotates the printhead 130 at a constant speed from one orientation to another orientation. In some examples, the rotation mechanism 110 rotates the printhead 130 at varying speeds from one orientation to another orientation. The varying speeds may be determined according to a formula.

Another rotation parameter is an amount of pause time at a particular orientation, such as for example the second orientation 150B. Rotation may pause at the particular orientation to allow settled particles to return to suspension or solution.

Another rotation parameter is the number of repetitions of a particular rotation sequence. In some cases, the number of repetitions is one, but in other cases the number of repetitions is greater than one.

Other rotation parameters include the maximum idle time, and/or the maximum printing time, between rotations. If the printer 100 is in the idle state for a period of time that exceeds the maximum idle time, a rotation is performed. Similarly, if the printer 100 is in the printing state for a period of time that exceeds the maximum printing time, a rotation is performed. These maximum times allow the intermittent rotation to be timed so as to maintain particles in the liquid in suspension or solution. The timing of rotations is discussed subsequently in greater detail with reference to FIGS. 5 and 6A-6B.

The rotation parameters are not limited to those described herein; additional and/or alternative rotation parameters may be associated with particular liquids.

Rotation parameters may also be determined by the length of time since the printhead 130 was last rotated. The time of the last rotation may be stored in a non-volatile memory of the printer 100 and/or in an external device, such as for example a computer (not shown), that is coupled to the printer 100. While exceeding the maximum idle time and/or the maximum print time since the last rotation causes rotation of the printhead 130 to be initiated during times when the printer 100 is powered on, in some cases the printer 100 may be powered off, with the printhead 130 installed, for a period of time that exceeds the maximum idle time, in some cases by a considerable amount. This situation may be detected during an initiation operation the next time the printer 100 is powered on, and a different rotation operation, according to a different set of rotation parameters from those used when the maximum idle/print time is exceeded, may be performed. For example, one or more of the angle, speed, direction, repetitions, etc. may be increased to more effectively return the settled particles to suspension or solution.

In addition, a rotation operation may include multiple rotations, each of which uses a different set of rotation parameters. For example, a rotation operation may include a first rotation from first 150A to second 150B and back to first 150A orientations at a first angle and speed, followed by a second rotation from first 150A to second 150B and back to first 150A orientations at a second angle and speed. This allows more complex rotation operations to be used where appropriate for particular liquids.

The printhead rotator or rotation mechanism 110 can be any mechanical arrangement capable of rotating the printhead 130. In one example, the rotation mechanism 110 includes a shaft 112, coupled to the printhead 130, that controllably rotates in at least one direction 114 so as to correspondingly rotate the printhead 130. The rotation mechanism 110 may be an arrangement of gears, cams, transmissions, and/or other mechanical components capable of rotating the shaft 112 and thus the printhead 112. In another arrangement, the rotation mechanism 110 may cause the printhead 130 to translate in addition to rotate. In some examples, a cap is installed on the printhead 130 prior to rotation by a capping mechanism, as described subsequently with reference to FIG. 2.

In examples where a bulk supply of the liquid is provided within the printhead 130, the bulk supply is rotated when the printhead 130 is rotated, thus maintaining particles in the liquid in suspension or solution as has been described. In examples where the bulk supply of the liquid is contained external to the printhead, particles in the liquid can be maintained in suspension or solution via alternative mechanisms, such as for example by stirring the bulk supply with a mechanical or magnetic stirrer, or by shaking, vibrating, etc. the bulk supply.

Figure 2:
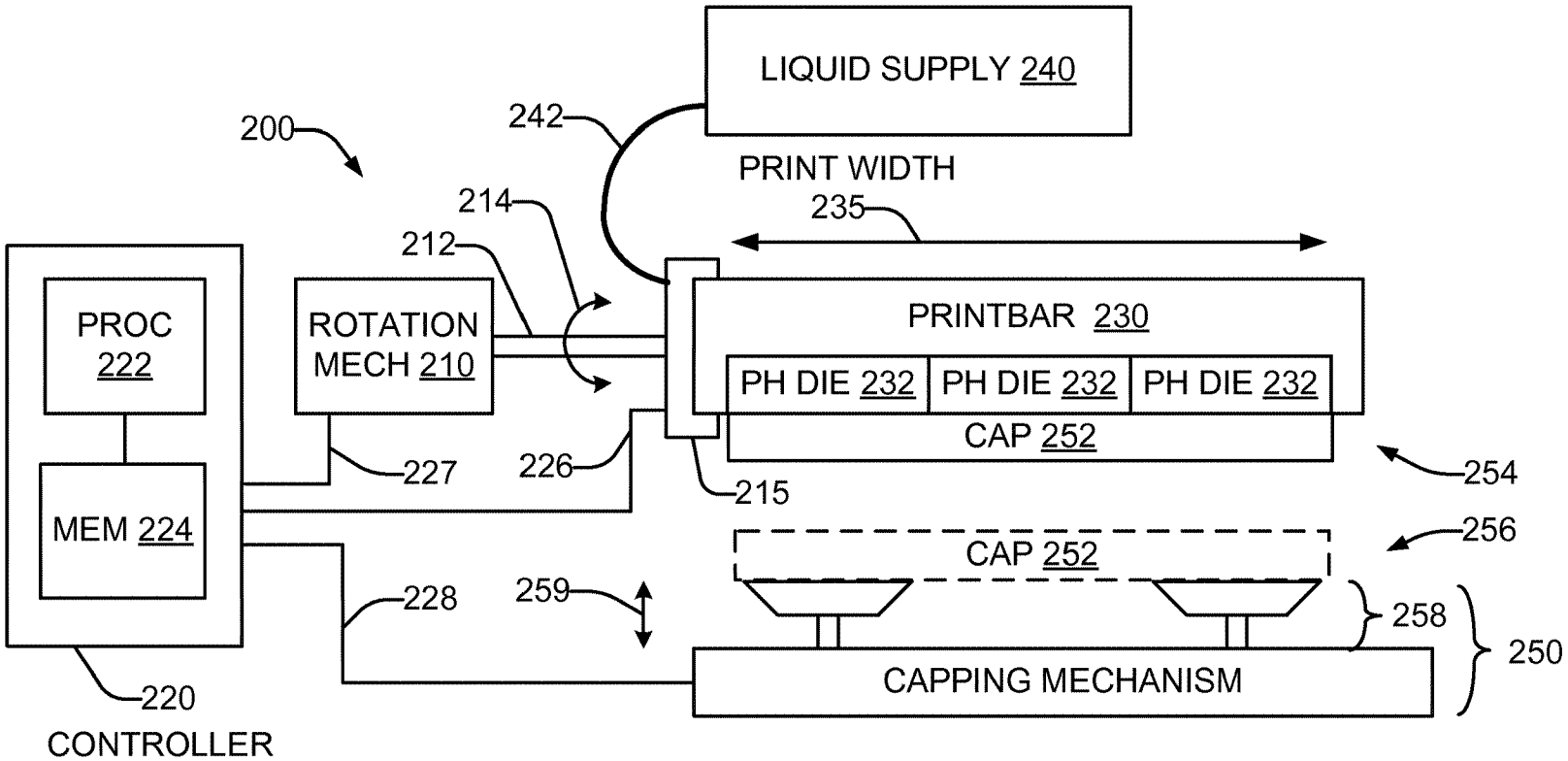
FIG. 2 is a schematic block diagram of another printing system in accordance with an example of the present disclosure.

Considering now another printer, and with reference to FIG. 2, a printer 200 includes a printbar 230. The printbar 230 includes an arrangement of plural printhead die 232, and thus a printbar may be considered to be a printhead which has plural printhead die 232. Each printhead die 232 is the same as or similar to that described heretofore with reference to FIG. 1A. In one example, each printhead die 232 has a substantially linear array of liquid-ejecting nozzles, and the arrangement staggers the plural printhead die 232 in at least two rows such that the printhead die 232 collectively span a print width 235 of a print medium (not shown). In this example, the printbar 230 is a page-wide printbar, maintained in a fixed position during a printing operation, that is capable of controllably ejecting or emitting liquid drops onto any location across the width of the print medium, using inkjet technology that may be thermal inkjet, piezoelectric inkjet, or other types.

In other examples, a single printbar does not span the print width 235. In such examples, an arrangement of multiple printbars may be used to span the print width 235.

A bulk supply 240 of the liquid is external to the printbar 230 and fluidically coupled thereto via tubing 242, which may be of any length. The printbar 203, as is discussed subsequently in greater detail with reference to FIG. 3, includes a liquid flow path from the ink supply to the printhead die 232.

In some examples, the printbar 230 is removably installed in the printer 200 and may be replaced with another printbar 230 if or when appropriate. The printbar 230 is installed in, or mates with, a printbar receptacle 215 of the printer 200. The receptacle 215 may provide features for mechanical attachment and retention of the printbar 230 in the printer 200. The receptacle 215 provides fluidic coupling between the tubing 242 and the printbar 230 for the printbar 230 to receive liquid from the liquid supply 240, and electrical coupling between a controller 220 and the printbar 230 for the printbar to receive, via line(s) 226, electrical signals from the controller 220 which control the ejection of liquid drops by the printhead die 232. The electrical signal may also control other functions within the printbar 230.

The receptacle 215 may be fixedly attached or attachable to a printhead rotator or rotation mechanism 210. For example, a shaft 212 of the rotation mechanism may be attached to the receptacle 215 such that the receptacle 215 rotates in conjunction with the shaft 212 and thus rotates the printbar 230 as well. The rotation mechanism 210 may otherwise be the same as or similar to the rotation mechanism 110 (FIG. 1A). The controller 220 provides rotation control signals and/or rotation parameters to the rotation mechanism 210 via line(s) 227.

The printer 200 also includes a capping mechanism 250. The capping mechanism 250 removably installs a cap 252 on the printbar 230. More specifically, the cap 252 fluidically seals the nozzles of the printhead die 232 of the printbar 230. This inhibits or prevents liquid in the nozzles from drying out during rotation, which can in turn clog or damage the printhead die 232 and thus the printbar 230. The cap 252 is illustrated in both a capped position 254 (solid lines) covering the nozzles, and an uncapped position 256 (dashing lines) separated from the nozzles. The capping mechanism 250 is controlled by electrical signals issued by the controller 220 via line(s) 228. The capping mechanism 250 is instructed to cap the printhead die 232 before rotating the printbar 230, and may be instructed to uncap the printhead die 232 after rotating the printbar 230. In the example of FIG. 2, the cap 252 is a single cap 252 for all the printhead die 232, while another example may have a separate cap for each printhead die 232. The cap 252 may have features which attach to mating features on the printbar 230 to hold the cap 252 in place.

In some examples, the capping mechanism 250 and the cap 252 may be part of a removable assembly that includes the printbar 230. In other examples, the cap 252 may be part of a removable assembly that includes the printbar 230, while the capping mechanism 250 remains with the printer 200. The capping mechanism 250 can be any mechanical arrangement capable of installing the cap 252 on the printbar 230. The capping mechanism 250 is schematically illustrated in the example of FIG. 2 as having a movable portion 258 that translates in the direction 259 to move the cap 252 between the capped position 254 and the uncapped position 256, and to attach the cap 252 to, or remove the cap 252 from, the printhead die 232 or printbar 230.

In one example, the controller 220 includes a processor 222 communicatively coupled to a computer-readable medium such as for example a memory 224. In this example, the functions of the controller 220 are implemented at least in part by processor-readable and -executable instructions stored in the memory 224.

Figure 3:
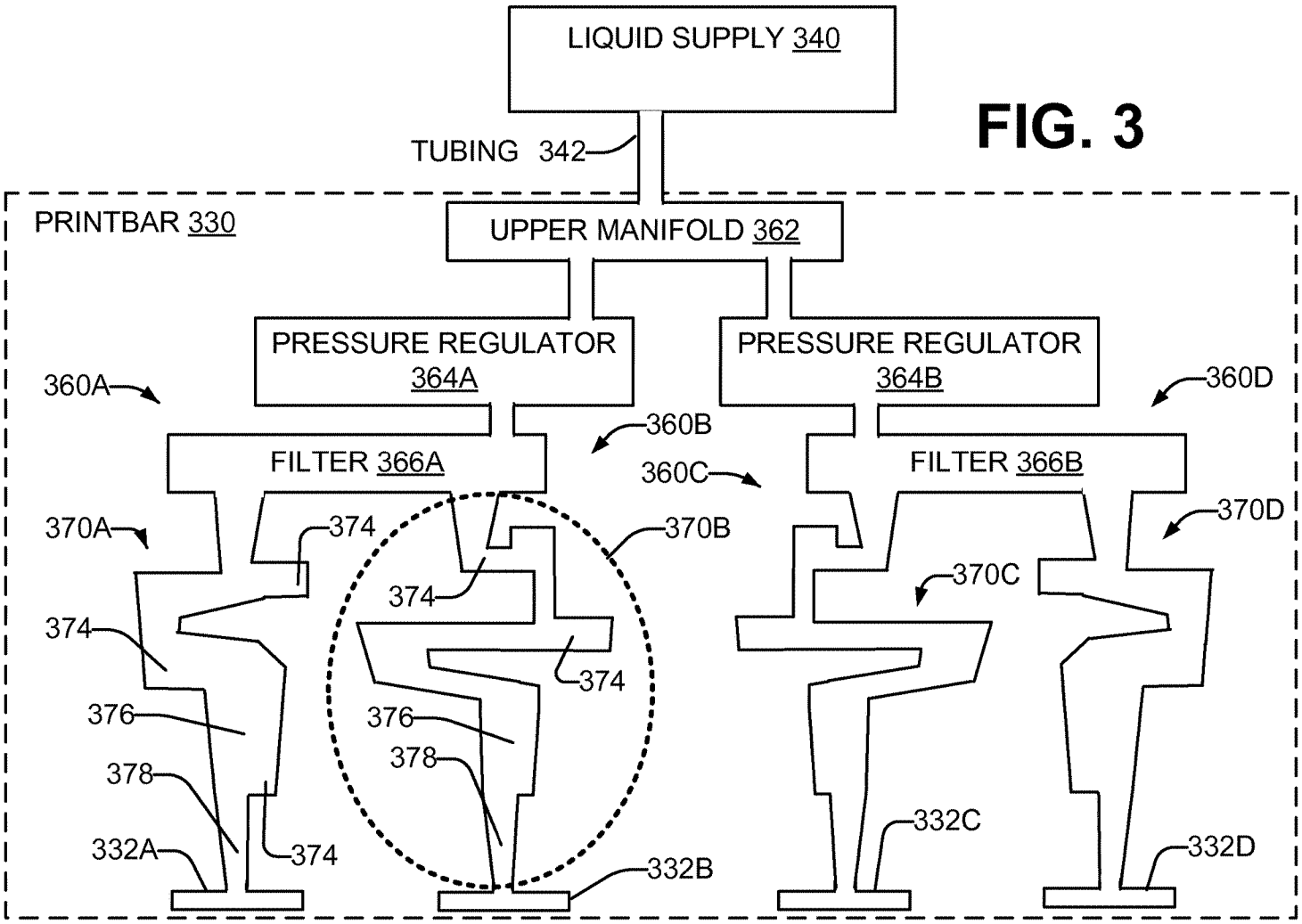
FIG. 3 is a schematic block diagram of liquid flow paths in an example printbar of the printing system of FIG. 2 in accordance with an example of the present disclosure.

Considering now in greater detail a printbar, and with reference to FIG. 3, a printbar 330 is coupled to a liquid supply 340 via tubing 342. The printbar 330 includes plural printhead die 332. The printbar 330 may be the printbar 230. In addition, a portion of the printbar 330 that includes a single printhead die 332 may be the printhead 130.

The printbar 330 provides parallel liquid flow paths, collectively 360, between the tubing 342 and each one of the printhead die 332. Four printhead die 332A-332D are illustrated in FIG. 3, as are four corresponding liquid flow paths 360A-360D.

The tubing 342 fluidically couples to an input of an upper manifold 362 of the printbar 330. The upper manifold 362 distributes the liquid to other elements of the printbar 330. The output of the upper manifold 362 fluidically couples to the input of at least one pressure regulator 364 (two pressure regulators 364A-364B are illustrated). Each pressure regulator 364 maintains the liquid at a desired pressure within the printbar 330. The output of each pressure regulator 364 fluidically couples to the input of a filter 366 (two filters 366A-366B are illustrated). The filter 366 removes impurities and/or air bubbles from the liquid as it passes through the filter. The filter 366 has at least one output, each of which fluidically couples to one of the printhead die 332 through a corresponding branch 370. Branch 370B is indicated by dashed lines, while branches 370A, 370C, and 370D are indicated generally. Each liquid flow path 360A-360D and/or branch 370A-370D may have geometric features which are different from at least one other of the flow paths or branches. Each branch 370A-370D may be, or may include, a lower manifold 376. The geometries of the liquid flow paths 360A-360D and/or branches 370A-370D may be more complex and/or non-symmetric in a printer that uses several different types of liquids (for example, inks of different colors). In order to route the various liquids to different locations on different ones of the printhead die 332 along the length of the printbar 330, physical constraints can arise due to the printbar's plastic molding, printbar mechanical features used during the manufacturing process, and the avoidance of other liquid paths on the printbar which creates non-uniform manifold geometry having different flow characteristics and areas prone to particle settling.

The geometric features within a path 360A-360D and/or a branch 370A-370D may vary in size. For instance, large open areas around the filter may narrow to smaller channels near printhead die 332A-332D. There may be large boundary layers, or zones of reduced flow 374 relative to a nominal flow, in places where the geometry changes in size or shape, or is not of a consistent circular diameter. A branch 370A-370D may narrow considerably adjacent the printhead die 332A-332D. Particles of solids may collect and/or build up in or around the geometric features 374, 374, and it may be difficult or impossible to adequately clear this sediment by liquid flow through the path or branch. Parallel flow paths 360A-360D and branches 370A-370D can exacerbate this, because once one of the paths is cleared, liquid will tend to flow to the cleared path rather than to the others. Periodically rotating the printbar 330, such as for example during idle periods, can prevent the collection and/or buildup of these particles and thus avoid this situation.

In some examples, the position in the flow paths of the pressure regulator 364 and the filter 366 may be reversed. In addition, additional or alternative manifolds may be used at other locations in the flow paths.

Considering now the gravitational effects upon particles in a liquid within an example printhead or printbar, and with reference to FIGS. 4A-4E, a portion of a flow path of an example printhead 130 (FIG. 1) or printbar 230 (FIG. 2), 330 (FIG. 3) is illustrated at various stages of rotation 400A-400E of the printhead or printbar. The flow path portion includes a flow branch 470 to a printhead die 432. The flow branch 470 may be a flow branch 370 (FIG. 3), and the printhead die 432 may be the printhead die 332 (FIG. 3). A gravity vector 405 acts upon the liquid within the flow path portions in a top to bottom direction as depicted.

In stage 400A, particles 410 of the liquid are in suspension or solution. If the printhead or printbar remains in the same orientation for an extended period of time, as in stage 400B, at least some of the particles 410 settle in certain regions 420. The rate and extent of settlement depends, at least in part, on characteristics of the liquid. One undesirable effect of the settlement is to change the concentration of particles in the liquid drops ejected or emitted from the nozzles of the printhead die 432 resulting in the printing output having reduced image quality. Another undesirable effect of the settlement is to restrict or clog the flow of the liquid through the printhead or printbar, which may make it inoperable.

The printhead or printbar is rotated in order to return the settled particles 410 to suspension or solution. In stage 400C, a first angle of rotation in stage 400C causes the particles 410 to begin dispersing from the regions 420. This effect becomes more pronounced in stage 400D, which may correspond, for example, to the second orientation 150B at time T2 (FIG. 1 B). When the printhead or printbar is rotated, at stage 400E, back to the same orientation as in stage 400A, the particles 410 have been returned to suspension or solution. This returns the concentration of particles 410 in the liquid to the desired range, and unrestricts and unclogs the flow branch 470.

For clarity of illustration, FIG. 4B-4D depicts a situation in which most of the particles 410 in the liquid have settled in the regions 420. This may occur if the printhead or printbar remains in a given position for a long period of time, as may occur when the printer is powered off. However, when the printer is powered on but printing is not occurring, the printhead or printbar can be rotated frequently enough to avoid the significant setting of the particles 410 that is depicted in FIG. 4B, and instead maintain the particles 410 in suspension or solution as in FIG. 4A.

Figure 5A:
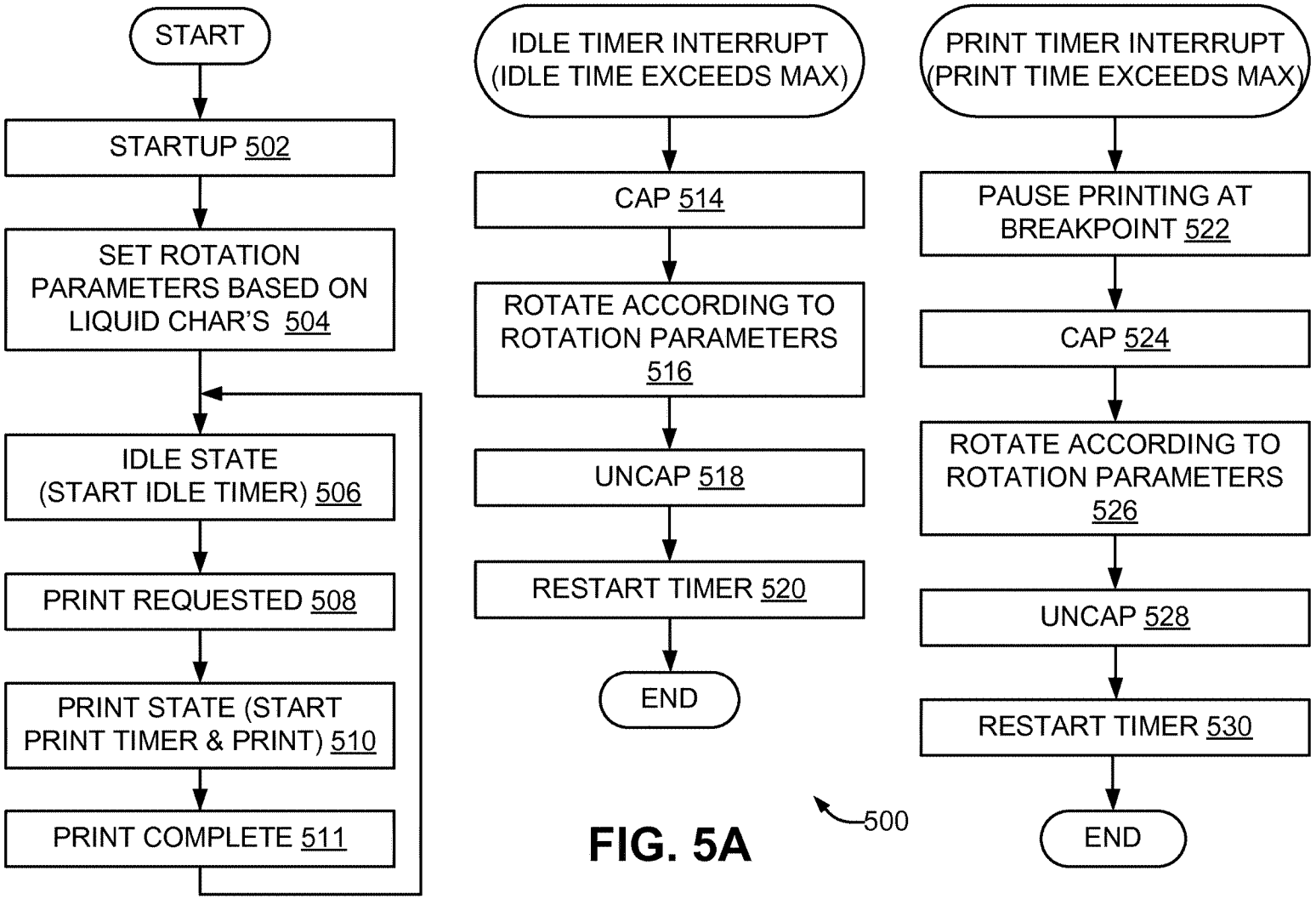
FIGS. 5A-5B are flowcharts in accordance with an example of the present disclosure of a method for maintaining a printhead.
Figure 5B:
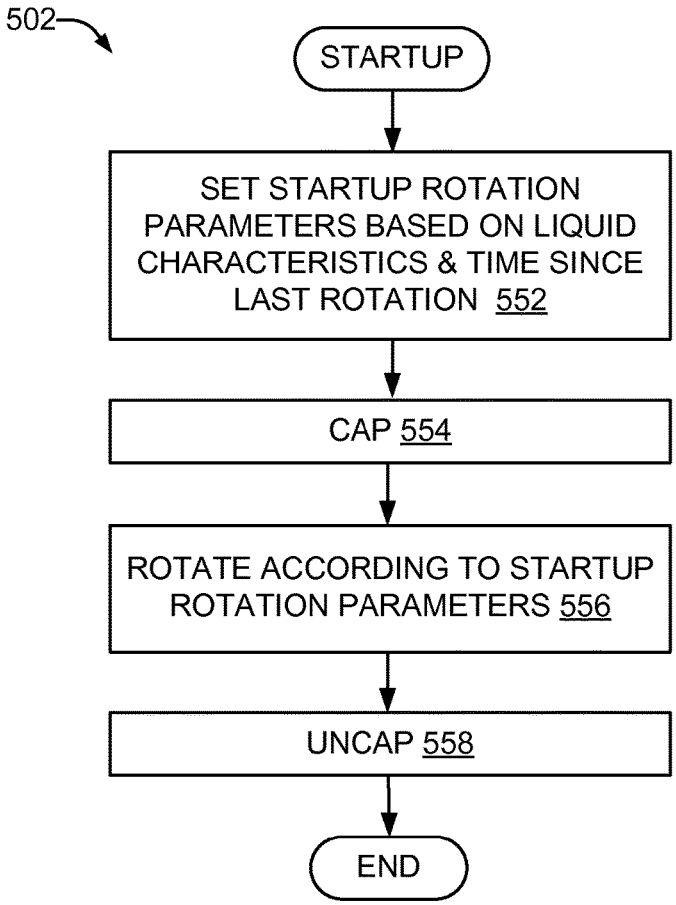

Consider now, with reference to FIGS. 5A-5B, flowcharts of a method for maintaining a printhead installed in a printer. Alternatively, the flowcharts may be considered as flowcharts of a controller, such as controller 120 (FIG. 1), 220 (FIG. 2) of a printer, which implements the method at least in part. In some examples, some or all of the controller may be implemented in hardware, firmware, software, or a combination of these. Where the controller is implemented in whole or in part in firmware or software, the controller may include a memory (such as memory 224, FIG. 2) having the firmware or software instructions, and a processor (such as processor 222, FIG. 2) which is communicatively coupled to the memory 224 to access and execute the instructions. The controller may also include one or more timers, such as watchdog timers, which can generate an interrupt when a time duration exceeds a predefined maximum time.

The method 500 begins, at 502, by performing a startup operation of the printer. The printer startup operation may be performed when power to the printer is turned on, or at other times. The startup operation 502 begins, at 552, by setting startup rotation parameters for rotation of a printhead or printbar based on characteristics of the liquid to be ejected or emitted from the printhead or printbar and on the time duration since the last rotation was performed. The startup rotation parameters can include the rotation parameters discussed heretofore with reference to FIGS. 1A-1B and/or other rotation parameters. The time duration may be calculated, in one example, from a time of last rotation that is stored in a memory of the printer (such as for example memory 224 of the controller 200, FIG. 2) and the current time. A longer time duration since the last rotation may result in startup rotation parameters that cause a longer and/or more vigorous rotation of the printhead or printbar, in order to compensate for the more extensive particle settling that results from the longer time duration since the last rotation. If the time duration since the last rotation is sufficiently short, the startup rotation parameters may be set such that no rotation is performed. At 554, the printhead or printbar is capped (if it is not already capped). At 556, the printhead or printbar is rotated according to the startup rotation parameters. At 558, printhead or printbar is uncapped, and the startup 502 ends.

After the startup 502 has ended, rotation parameters for rotation of a printhead or printbar are set, at 504, based on the characteristics of the liquid to be ejected or emitted from the printhead or printbar. The rotation parameters can include the rotation parameters discussed heretofore with reference to FIGS. 1A-1B and/or other rotation parameters. The rotation parameters set at 504 may be different from the rotation parameters set at 552 for the startup operation 502.

At 506, an idle state is entered and an idle timer is started. The idle timer is set to generate a signal, such as an interrupt, when a maximum idle time is exceeded. In one example, the rotation parameters and the maximum idle time are coordinated such that the printhead or printbar rotates substantially continuously while the printer is in the idle state. If a request is received at the printer to perform a printing operation at 508, then at 510 the idle state is exited and a printing state is entered. A print timer is also started. The print timer may be the same timer as the idle timer, or a different timer. The print timer is set to generate a signal, such as an interrupt, when a maximum idle time is exceeded.

At 511, the requested printing completes, and the method branches to 506 where the printer returns to the idle state and the idle timer is restarted at 506.

If the idle time is exceeded, then at 514 the printhead or printbar is capped. At 516 the printhead or printbar is rotated according to the rotation parameters. At 518, after the rotation has been completed, the printhead or printbar is uncapped. At 520, the idle timer is reset and restarted If the print time is exceeded, then at 522 the printing is paused at a logical breakpoint. For example, in a sheet-fed printer, the pause may occur between pages. As another example, in a web printer, the pause may occur at a time when the flow of the web is stopped, such as for example when a roll of print media is being changed. At 524 the printhead or printbar is capped. At 526 the printhead or printbar is rotated according to the rotation parameters. At 528, after the rotation has been completed, the printhead or printbar is uncapped. At 530, the print timer is reset and restarted.

Figure 6A:
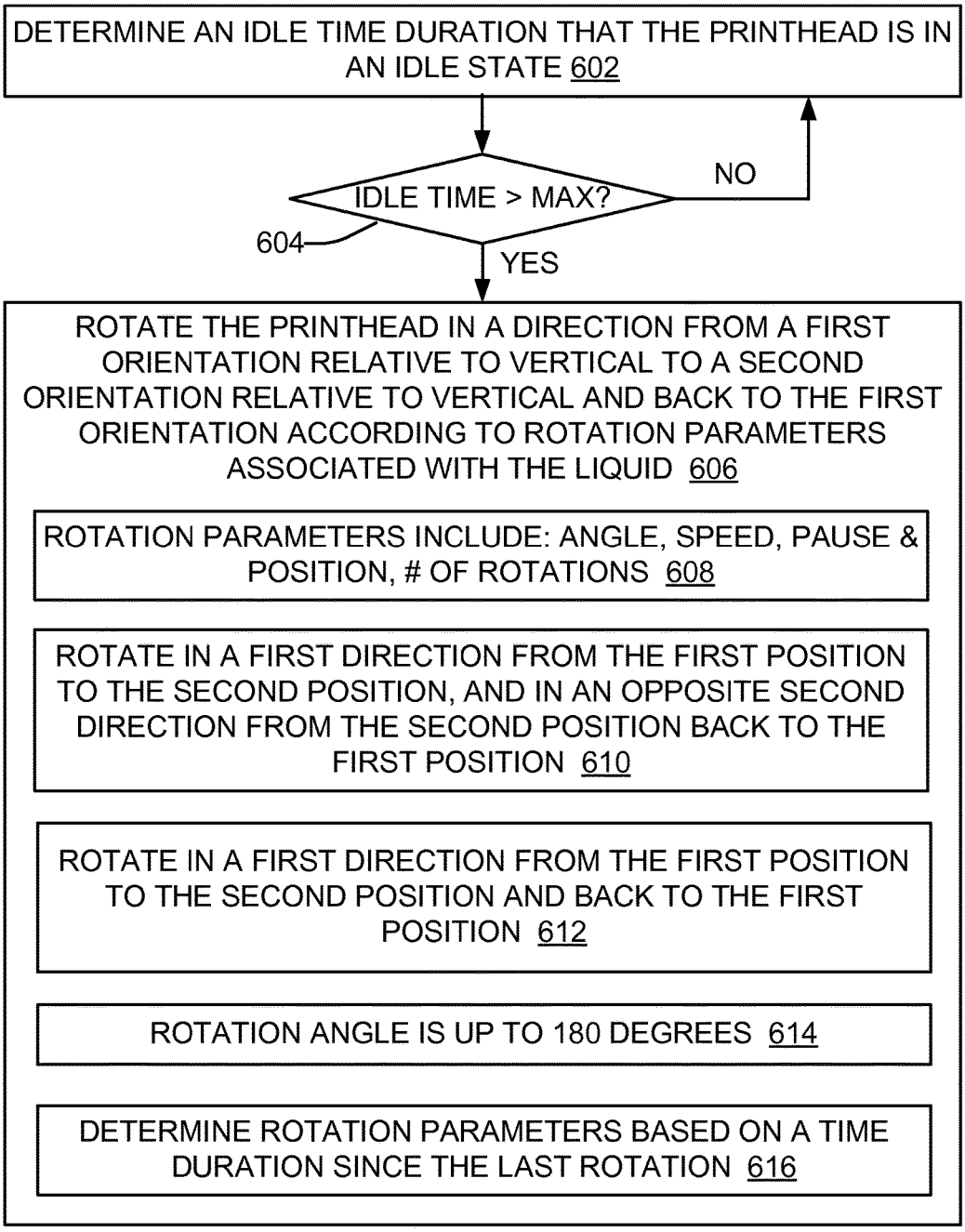
FIGS. 6A-6B are flowcharts in accordance with an example of the present disclosure of another method for maintaining a printhead.
Figure 6B:
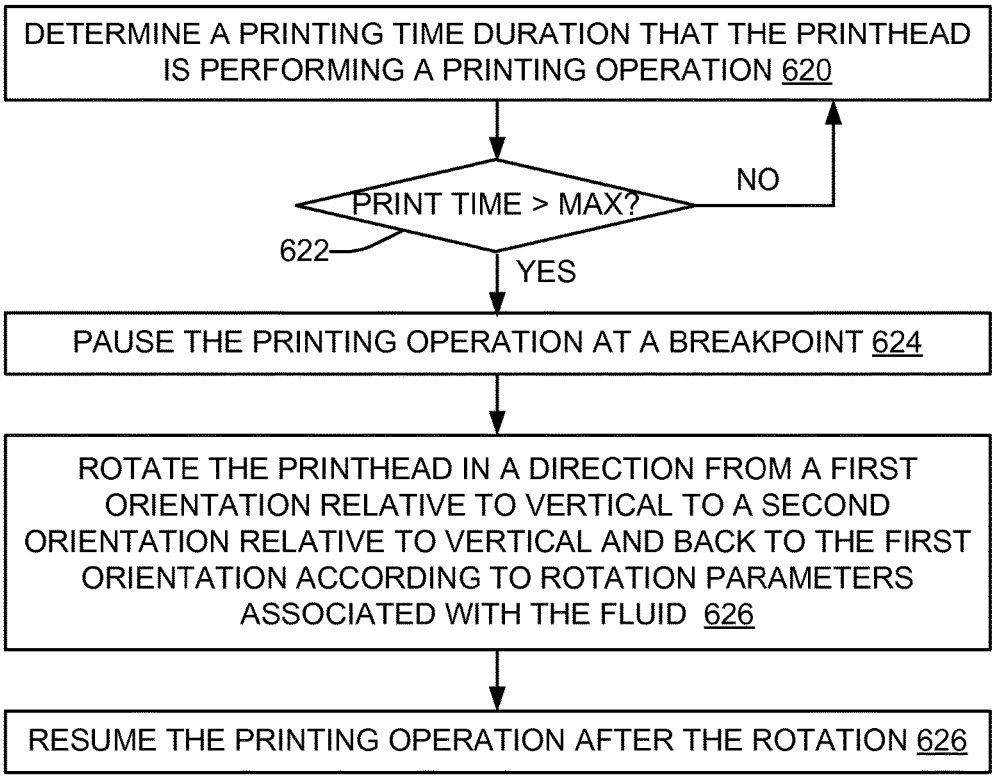

Consider now, with reference to FIGS. 6A-6B, flowcharts of another method for maintaining a printhead installed in a printer, or of another controller, at 602 an idle time duration in which the printhead is in an idle state is determined. At 604, if the idle time duration has not exceeded a maximum allowable idle time ("No" branch of 604), then the flow returns to 602. If the idle time duration has exceeded a maximum allowable idle time ("Yes" branch of 604), then at 606 the printhead or printbar is rotated in a direction from a first orientation relative to vertical to a second orientation relative to vertical and then back to the first orientation. The rotation is performed in accordance with rotation parameters associated with a liquid, drops of which can be controllably emitted or ejected from the printhead. At 608, in some examples, the rotation parameters include at least one of a rotation angle, a rotation speed, a pause in rotation at a particular angular position, a number of rotations, and/or other parameters as have been described herein. At 610, in some examples, the printhead is rotated in a first direction from the first position to the second position, and in an opposite second direction from the second position back to the first position. At 612, in some examples, the printhead is rotated in a first direction from the first position to the second position and then back to the first position. At 614, in some examples, the rotation angle may be up to 180 degrees. At 616, in some examples, the rotation parameters are determined based at least in part on a time duration since the last rotation.

At 620, a printing time duration in which the printhead is in a printing state is determined. At 622, if the printing time duration has not exceeded a maximum allowable printing time ("No" branch of 622), then the flow returns to 620. If the printing time duration has exceeded a maximum allowable printing time ("Yes" branch of 622), then at 624 the printing operation is paused at a breakpoint. At 626, the printhead or printbar is rotated in a direction from a first orientation relative to vertical to a second orientation relative to vertical and then back to the first orientation. At 626, the printing operation is then resumed after the rotation is completed.

In some examples, at least one block or step discussed herein is automated. In other words, apparatus, systems, and methods occur automatically. As defined herein and in the appended claims, the terms "automated" or "automatically" (and like variations thereof) may be understood to mean controlled operation of an apparatus, system, and/or process using computers and/or mechanical/electrical devices without the necessity of human intervention, observation, effort and/or decision.

From the foregoing it will be appreciated that the printing systems, printers, and methods provided by the present disclosure represent a significant advance in the art. Relative to recirculation pumps that are complex, noisy, and operate continuously, the rotation mechanisms can be much simpler, operate intermittently (often at widely spaced intervals), and may make little noise. As a result, the printers can consume significantly less power. The rotation mechanism may operate continuously during idle periods to slowly rotate the printhead or printbar over the period of many minutes or hours to keep the particles in suspension or solution; this also reduces noise and power consumption. Users may tend to leave them powered up when not in use, which avoids sediment settling, and which shortens the time after power-on to achieve adequate print output image quality. Rotation of the printhead or printbar keeps particles in suspension even in corners and low-flow areas of geometry, and reduces or eliminates the need to "spit" waste ink during idle periods to keep the nozzles healthy. Rotation also reduces or prevents degradation in liquids which tend to degrade with the shear generated by recirculation pumps.

Although several specific examples have been described and illustrated, the disclosure is not limited to the specific methods, forms, or arrangements of parts so described and illustrated. For example, while the printing systems and printers have been described and illustrated with regard to printing with one liquid, other printing systems and printers may print with several different liquids (e.g. color printing with black, magenta, cyan, and yellow inks), and thus some or all of the structure may be replicated for the additional liquids. In one example, a printer may include multiple printheads for the multiple liquids, or a printbar may include multiple printhead die for the multiple liquids. This description should be understood to include all novel and non-obvious combinations of elements described herein, and claims may be presented in this or a later application to any novel and non-obvious combination of these elements. The foregoing examples are illustrative, and different features or elements may be included in various combinations that may be claimed in this or a later application. Unless otherwise specified, operations of a method claim need not be performed in the order specified. Similarly, blocks in diagrams or numbers (such as (1), (2), etc.) should not be construed as operations that proceed in a particular order. Additional blocks/operations may be added, some blocks/operations removed, or the order of the blocks/operations altered and still be within the scope of the disclosed examples. Further, methods or operations discussed within different figures can be added to or exchanged with methods or operations in other figures. Further yet, specific numerical data values (such as specific quantities, numbers, categories, etc.) or other specific information should be interpreted as illustrative for discussing the examples. Such specific information is not provided to limit examples. The disclosure is not limited to the above-described implementations, but instead is defined by the appended claims in light of their full scope of equivalents. Where the claims recite "a" or "a first" element of the equivalent thereof, such claims should be understood to include incorporation of at least one such element, neither requiring nor excluding two or more such elements. Where the claims recite "having", the term should be understood to mean "comprising".

What is claimed is:

1. A printer, comprising:

a rotation mechanism coupleable to a liquid-ejecting printhead in the printer; and a controller coupled to the rotation mechanism to control the rotation mechanism to intermittently rotate the printhead, during a non-printing time, from a first orientation relative to vertical to a second orientation relative to vertical and back to the first orientation;

wherein the controller is to interrupt printing when a maximum printing time has elapsed between rotations of the printhead and rotate the printhead.

2. The printer of claim 1, wherein the second orientation reorients, with respect to the first position, a gravity vector operating on the printhead so as to disperse particle sediment within the printhead.

3. The printer of claim 1, wherein the intermittent rotation is timed to maintain particles in the liquid in suspension.

4. The printer of claim 1, wherein the printhead comprises a printhead die, wherein the printhead has a liquid flow path that narrows adjacent the printhead die, and wherein the printhead die is disposed at a bottom of the printhead in the first orientation.

5. The printer of claim 1, wherein the printhead includes a liquid flow path having a geometric feature where sediment is inadequately cleared by liquid flow through the printhead.

6. The printer of claim 1, further comprising a cap, the controller to install the cap over the printhead prior to rotation so that the printhead is capped by the cap during rotation by the rotation mechanism.

7. The printer of claim 1, wherein the rotation mechanism is to rotate the printhead through 360 degrees.

8. The printer of claim 1, wherein the rotation mechanism is to rotate the printhead at a speed that varies during the rotation.

9. The printer of claim 1, wherein the rotation mechanism is to rotate the printhead through multiple rotations, each rotation using a different set of rotation parameters.

10. The printer of claim 9, wherein the rotation parameters including any of: rotation speed, number of repetitions, and angular distance.

11. A printer, comprising:

a printhead rotator coupleable to a printbar having plural printhead die connected through parallel flow paths to a liquid supply, each printhead die cappable by a cap;

a controller coupled to the printhead rotator to intermittently rotate the printbar, when capped, from a first orientation relative to vertical to a second orientation relative to vertical and back to the first orientation during a non-printing time.

12. The printer of claim 11, wherein the printbar is a page-wide printbar having the plural printhead die arranged to collectively span a printable width of a print medium.

13. The printer of claim 11, wherein the printbar comprises the cap.

14. The printer of claim 11, wherein the printbar has parallel liquid flow paths from a liquid supply to plural ones of the printhead die.

15. A method for maintaining a printhead, comprising:

determining an idle time duration that the printhead is in an idle state; and if the idle time duration exceeds a maximum idle time associated with a liquid coupled to the printhead, rotating the printhead in a direction from a first orientation relative to vertical to a second orientation relative to vertical and back to the first orientation according to rotation parameters associated with the liquid.

16. The method of claim 15, wherein the rotation parameters that are controlled based on a characteristic of the liquid being used include a rotation angle and a rotation speed.

17. The method of claim 15, comprising:

capping the printhead prior to the rotating; and uncapping the printhead after the rotating.

18. The method of claim 15, wherein the rotating includes rotating the printhead up to 180 degrees in a first direction from the first position to the second position and rotating the printhead in an opposite second direction from the second position back to the first position.

19. The method of claim 15, comprising:

determining a printing time duration during which the printhead is performing a printing operation; and if the printing time duration exceeds a maximum printing time associated with a liquid coupled to the printhead, pausing the printing operation, rotating the printhead from the first position to the second position and back to the first position according to the rotation parameters associated with the liquid, and resuming the printing operation after the rotating.

20. The method of claim 15, wherein the rotation parameters are dependent upon a time since the last rotation.

* * * * *